United States Patent [19]

Willette

[11] Patent Number: 4,717,311

[45] Date of Patent: Jan. 5, 1988

[54] CENTRIFUGAL PUMP

[76] Inventor: Russell J. Willette, 718 E. Spruce St., Sault Ste. Marie, Mich. 49783

[21] Appl. No.: 883,600

[22] Filed: Jul. 9, 1986

[51] Int. Cl.[4] ..... F04D 29/42

[52] U.S. Cl. ..... 415/206; 415/219 C; 415/198.1

[58] Field of Search ..... 415/203, 204, 206, 207, 415/219 C, 219 B, 198.1, 199.1, 199.2, 199.3; 416/179

[56] References Cited

U.S. PATENT DOCUMENTS

| | | | |
|---|---|---|---|
| 1,355,982 | 10/1920 | Labour | 415/204 |
| 1,672,986 | 6/1928 | McKee | 415/199.3 |
| 3,460,748 | 8/1969 | Erwin | 415/219 A X |
| 3,608,088 | 9/1971 | Dorman et al. | 415/204 X |
| 3,907,456 | 9/1975 | Krienke | 416/179 X |

FOREIGN PATENT DOCUMENTS

| | | | |
|---|---|---|---|
| 29628 | of 1905 | United Kingdom | 415/198.1 |

*Primary Examiner*—Robert E. Garrett
*Assistant Examiner*—Joseph M. Pitko
*Attorney, Agent, or Firm*—Robert G. Mentag

[57] ABSTRACT

A centrifugal pump and method of making the same. The pump includes a casing having at least one impeller, an axial fluid inlet opening, and an outlet opening of a predetermined area. The impeller has a plurality of radially disposed impeller blades which may be straight or curved, and the circumferential area at the end of the blade tips is equal to the discharge area in the casing at the tips of the blades, and the last two mentioned areas are equal to the outlet opening area. In a multi-stage pump the width of the blades are successively larger.

6 Claims, 11 Drawing Figures

CENTRIFUGAL PUMP

BACKGROUND OF THE INVENTION

1. Technical Field

The field of this invention relates generally to centrifugal pumps, and more particularly, to a novel and improved impeller for use in said pumps, and a method for determining the size of an impeller for use in a centrifugal pump. Class 415, Subclass 206, U.S. Patent Office classification, appears to be the applicable general area of art to which the subject matter similar to this invention has been classified in the past.

2. Background Information

Heretofore, many impellers for centrifugal pumps have been devised which have variously curved vanes, as for example U.S. Pats. Nos. 3,547,554, 3,650,636, 3,788,765, 3,887,295, 3,973,872, 4,195,965. However, the aforementioned patents disclose impellers having vanes or blades which are shaped differently, and which function differently than applicant's hereinafter described impeller.

SUMMARY OF THE INVENTION

This invention provides an impeller for a single stage or a multiple stage centrifugal pump which is adapted to be rotatably mounted in a pump casing and receive fluid from an axial inlet opening. The impeller includes a drive shaft which has a plurality of vanes or blades mounted thereon, and which are radially disposed, and circumferentially spaced apart. The blades may be either curved or straight along the length thereof, and at least four of such vanes or blades are required. The vanes or blades may be straight or backwardly bent. The impeller may be of the open type, with the contour of the blades fitting the contour of the pump casing, or the impeller may be of the enclosed type with the vanes or blades being provided with integral shrouds. The quantity or amount of fluid flow of a liquid or gas, through the impeller is outwardly from the axis or center of the impeller. In accordance with the principles of the present invention, the area into which the pump is discharging has to be the same or larger than the total circumferential area at the discharge tips of the vanes or blades. Symmetrical blades give an equal outward pressure on both sides thereof and are preferable, but the blades can be of any shape if the circumferential area at the discharge tips thereof are the same. The size of the vanes or blades can be made to a proper size for a desired rate of flow at any given point in accordance with the rate of acceleration from the center of the impeller outward.

DESCRIPTION OF THE PREFERRED EMBODIMENT

Figure 1:
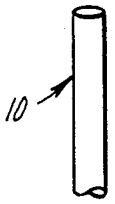
FIG. 1 illustrates a standing fluid container such as a vertical pipe with equal areas at the top and bottom ends thereof.
Figure 2:
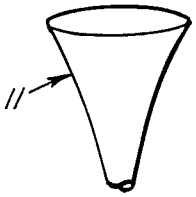
FIG. 2 illustrates a converging downwardly, sloping walled, vertical fluid container which has a circular area at the lower end thereof which is less than the circular area at the upper end thereof.

Larger flow areas are required for supplying enough water at slower velocities to maintain the same head, as if the water wasn't moving. This condition is attained by nature in a body of water, through the depth of the water. The deeper you go, the higher the static pressure. FIGS. 1 and 2 illustrate these conditions. FIG. 1 illustrates a standing fluid container 10, such as a vertical pipe, with equal cross section areas at the top and bottom ends. thereof, which would be similar to a column of water in a body of water, and having equal cross section areas throughout its length. FIG. 2 illustrates a downwardly converging, sloping walled, vertical fluid container 11 which has a circular cross section area at the lower end thereof, that is less than the circular area at the upper end thereof, and which simulates a column of water in this shape, in a body of water. If the simulated cylindrical column of water 10 illustrated in FIG. 1 were in a body of water, starting at the upper surface thereof, and there was a flow of water through such column, the velocity would be low, whereas if the column of water were longer, than the velocity through the same column would be higher in accordance with the depth or length of the column of water, or equivalent length of pipe, due to the static pressure being greater at the greater depth. The maximum flow through such a conduit 10 could only be sustained if there were larger areas at the top thereof, to maintain the same head, as if it wasn't flowing, and this situation is illustrated by the configuration of the fluid container 11 shown in FIG. 2. The shutoff pressure readings would be the same in both of the cases illustrated in FIGS. 1 and 2. However, if you would open the lower ends of the fluid containers shown in FIGS. 1 and 2, the pressure head reading on the container 10 of FIG. 1 would drop considerably because there would not be enough area at the top end thereof for supplying a quantity of liquid flow at lower velocities to maintain the same pressure head, as could be accomplished by the configuration of the container 11 shown in FIG. 2.

The basis or rule for the aforegoing factual situation is that, four times any depth will give a velocity flow twice as fast, as at that depth through an area one-half as large. Another way of saying it is, the square-root of any depth will tell you how much more area is needed at a one foot depth to sustain a full fluid pressure reading.

Figure 3:
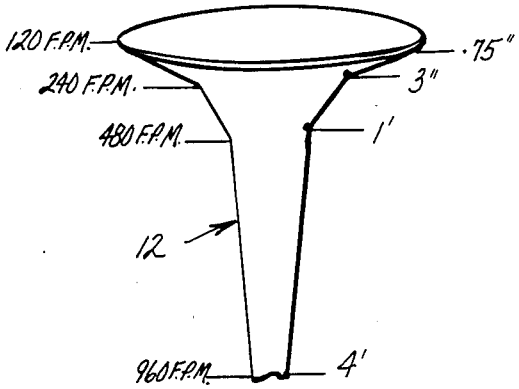
FIG. 3 is a converging downwardly, sloping walled, vertical fluid reservoir, with indicia to illustrate the relationship of the velocity of a fluid flowing at various areas through the reservoir.

FIG. 3 is a converging downwardly, sloping walled reservoir 12 which illustrates the accounting for distances and areas above the one foot level. As can be seen from the previous example, one-quarter of any depth upward, will show that area is to be doubled. One quarter of one foot is 3 inches, so at one foot the area is doubled. One-quarter of 3 inches is 0.75 inches etc. Whatever area you have at one foot then, should be about 16 times larger at the surface or upper end of the reservoir 12.

For example: A discharge from a ½ inch pipe, having an area of 0.19635 square inches at a depth of 16 feet, would require an area at the top of the reservoir 12 of 12.5664 square inches.

The following table shows the cross-section areas required in a reservoir, at increasing depths or static pressure head, to produce the velocities of fluid flow in feet per minute.

| Depth | Velocity | Area | Times as large |
|---|---|---|---|
| .04 inch | 30 F.P.M. | 12.5664 sq. in. | 64 |
| .1875 inch | 60 F.P.M. | 6.2832 sq. in. | 32 |
| .75 inch | 120 F.P.M. | 3.1416 sq. in. | 16 |
| 3. inch | 240 F.P.M. | 1.5708 sq. in. | 8 |
| 1 Foot | 480 F.P.M. | .7854 sq. in. | 4 |
| 4 Foot | 960 F.P.M. | .3927 sq. in. | 2 |
| 16 Foot | 1920 F.P.M. | .19635 sq. in. | 1 |

It will be seen from the aforegoing facts, that the square-root of any depth of fluid will determine how much faster the fluid will flow at that depth, than at one foot. The flow at one foot being 480 F.P.M.

In order to design an impeller that will accomplish the same results as the reservoir shown in FIG. 3, the size of discharge desired, and the elevation to which the water is to be pumped must be known. In the illustration of FIG. 3, the discharge area is 0.19635 square inches at a depth of 16 feet. By using 0.5 inch radius from the center of an impeller, and comparing that to 0.4 inch from the surface in a reservoir, it is seen that an area of 12.5664 square inch is required for a width of an impeller vane or blade at a radius of 0.5 of an inch.

The formula for calculating the radial rate of acceleration across the radius of an impeller is: a radius of 0.5 of an inch divided into any selected radius, which will indicate how much faster a fluid is flowing at that point. The factor of 0.5 of an inch is employed because it compares to the 0.4 of an inch head in a reservoir, where the velocity is 30 F.P.M.

Figure 4:
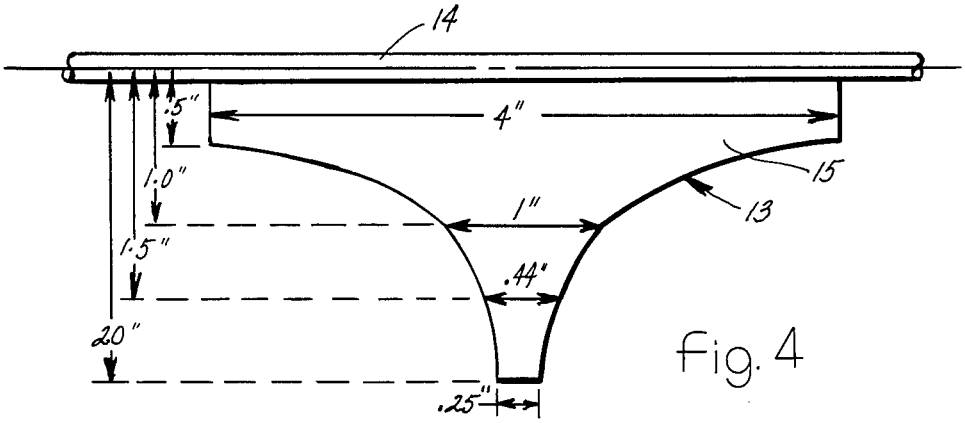
FIG. 4 is a diagram with indicia thereon, illustrating the designing of a proper size of an impeller vane in accordance with the amount of acceleration desired.

FIG. 4 is a diagram with indicia thereon, illustrating the designing of a proper size of an impeller vane in accordance with the amount of acceleration desired. The impeller is generally indicated by the numeral 13 and it includes a drive shaft 14 and an illustrative vane 15.

The formula for designing an impeller to a proper size for the amount of desired radial acceleration is: a radius of 0.5 of an inch divided by any selected radius, and then squaring the quotient, and multiplying the quotient by the width of the vane at a 0.5 of an inch radius equals the width of the blade at the radius selected.

EXAMPLES (a) 0.5″ divided by 1″ equals 0.5
  0.5 times 0.5 equals 0.25
  0.25 times 4 equals 1″ wide of a vane at a 1″ radius
(b) 0.5″ divided by 1.5″ equals 0.33
  0.33 times 0.33 equals 0.11
  0.11 times 4 equals 0.44″ width of a vane at a 1.5 radius
(c) 0.5″ inches divided by 2″ equals 0.25
  0.25 times 0.25 equals 0.0625
  0.0625 times 4 equals 0.25″ width of a vane at a 2″ radius The number of R.P.M.s required to attain the shut-off or static pressure of a pump can be calculated by dividing the circumference of the impeller into the velocity flow of the desired pressure.

EXAMPLE 6.95 lbs. = 16 ft. head = a velocity flow of 1920 F.P.M.
1920 F.P.M. divided by 16.75 ft. = 114.6 R.P.M., where 16.75 feet is the circumference of the impeller at a 32 in. radius.

Because a pump has to overcome a vacuum of 800 to 900 feet, it is necessary to add that much to the 1920 F.P.M. factor to get a fluid pressure flow of 1920 R.P.M. through the area of 0.19635 square inches, which size impeller was previously calculated.

Figure 5:
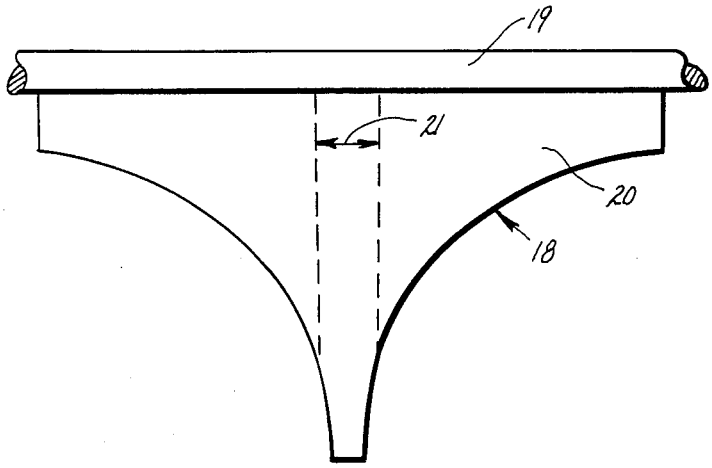
FIG. 5 is a meridional section view illustrating the calculation of the width of an impeller blade, and simulating the area needed to compare with the same amount of surface area in a body of water for a required discharge size.

FIG. 5 is a meridional section of an impeller 18 illustrating how to calculate the size or width of an impeller blade 20, to simulate what area is needed to compare with the same amount of surface area in a body of water, for a required discharge size. The numeral 19 designates the impeller drive shaft.

The area required at a 0.5 inch radius from the center line shaft 19 would be the same amount of surface area that is required in a body of water for the discharge size being used. From that starting point the impeller can be made to any desired diameter. The amount of R.P.M.s required at that diameter is then calculated, and the flow would be what was calculated for, through that size opening. The impeller blades do not have to be made as wide at the base or at the shaft 19, because the water would be coming in faster than it would be rotating at that point. The areas on each of the outer sides of the central portion 21, could be eliminated because those areas are not required, and it would be easier to manufacture. Those measurements are only used to calculate the size of the rest of the impeller blade.

Figure 6:
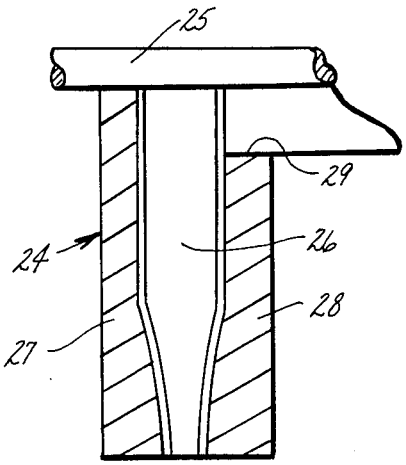
FIG. 6 is a meridional section view illustrating the part of an impeller that would be used in determining a discharge area which is the same as the circumferential area at the tips of the impeller blades.

FIG. 6 is a meriodional section illustrating the part of an impeller 24 that would be used in determining a discharge area which is the same as the circumferential area at the tips of the impeller blades. The impeller drive shaft is designated by the numeral 25. The numeral 26 designates the impeller vane or blade attached to the shaft 25. The numerals 27 and 28 designate the impeller blade case walls. The numeral 29 designates the axial intake for the impeller.

FIG. 6 shows the part (21 of FIG. 5) of an impeller 24 that would be used, and have a discharge area the same as the area at the tips of the impeller blades, as 26. Assuming an impeller blade width of 0.11 inches, the discharge area would be computed as follows: 0.11 inch times 18.8996 (the impeller circumference) = 2.074 square inches = 1.62 inch diameter pipe discharge. The impeller above at a 3 inch radius would be calculated by dividing 1920 by 1.5708 ft. = 1222 R.P.M. This would be for shut-off pressure. 2720 divided by 1.5708 ft = 1731 R.P.M., and this would be fluid pressure flow off 1920 R.P.M. through a ½ inch pipe.

In accordance with the present invention, the size of each stage is calculated for whatever pressure it is designed to attain. That is, with a single stage pump to get the proper measurements, the elevation it is pumping to must be known, and the size of the discharge outlet area must be known, to get the proper measurements for an impeller blade.

For example: A discharge outlet area of 0.19635 square inches from an elevation of 16 feet requires that a stage of an impeller has to be 64 times larger than 0.19635 square inches which is 12.5664 sq. inches.

Suppose it is desired to attain 64 feet elevation with four stages. The first stage would be designed to attain an elevation of 16 feet, the second stage an elevation of 32 feet, the third stage an elevation of 48 feet, and the last stage an elevation of 64 feet. Accordingly, the impeller blade of each succeeding stage would have to be wider.

Figure 7:
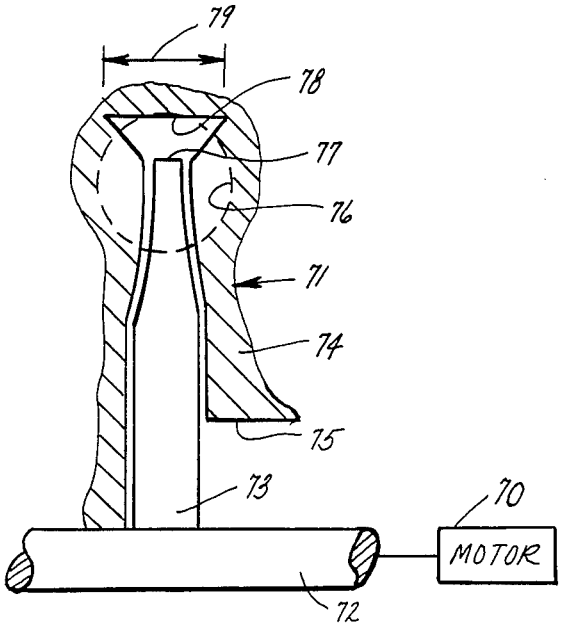
FIG. 7 is a meridional section view of one stage of a centrifugal pump made in accordance with the principles of the present invention.

FIG. 7 is a meriodional section view of a single stage of a single stage centrifugal pump 71 made in accordance with the principles of the present invention. The numeral 72 designates the impeller drive shaft, and the numeral 70 designates the drive motor. FIG. 7 illustrates how the impeller blade 73 narrows in accordance with the principles of the invention. The area of the discharge outlet at 76 should be at least the same as the area of the width of the tip 77 of the blade 73 times the distance around the circumference of the impeller. The diameter 79 of the outer cross section area 78 of discharge, at the blade tips 77, in the pump casing 74, at the periphery of the impeller, should be the same as the diameter of the discharge outlet area at 76. The numeral 75 designates the intake of the pump 71.

Figure 8:
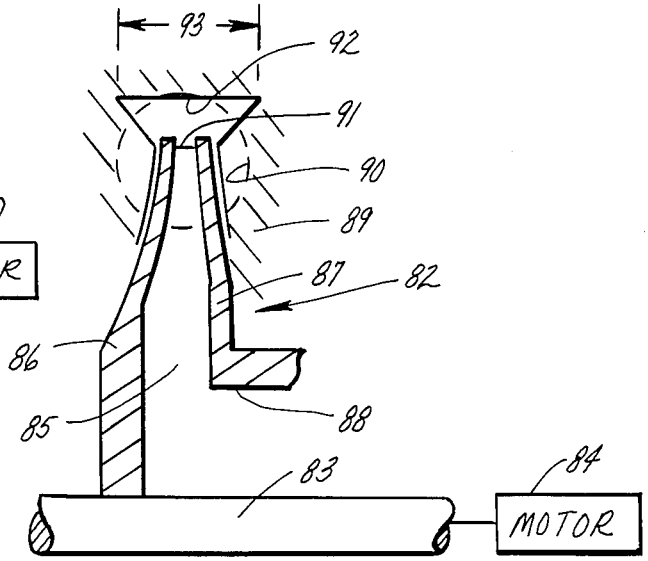
FIG. 8 is a meridional section view showing one stage of a centrifugal pump impeller, and illustrating the blades or vanes provided with enclosure shrouds.

FIG. 8 is a meridional section view showing a single stage of a single stage centrifugal pump 82, and illustrating the impeller blade 85 as being provided with enclosure shrouds 86 and 87. The numeral 83 designates the impeller drive shaft, and the numeral 84 designates the drive motor. The numeral 88 designates the intake of the pump 82. The area of the discharge outlet at 90 should be at least the same as the area of the width of the tip 91 of the blade 85 times the distance around the circumference of the impeller. The diameter 93 of the outer cross section area 92 of discharge, at the blade tips 91, in the pump casing 89, at the periphery of the impeller, should be the same as the diameter of the discharge outlet area at 90. The width of the blade 85 commences to narrow at about one-half of the length of the radius of the blade, measured from the center-line of the shaft 83.

The impeller blades 73 and 85 of FIGS. 7 and 8 respectively, would have the same blade measurements in their respective illustrated single stage centrifugal pumps. The impeller in each case should have at least four impeller blades, but a larger number of blades could also be employed.

Figure 10:
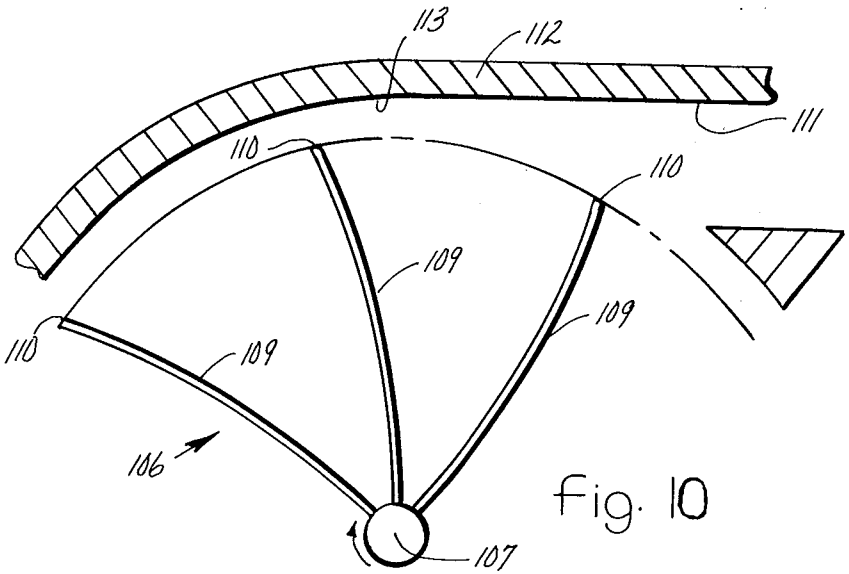
FIG. 10 is a fragmentary, radial section view of a centrifugal pump impeller, illustrating the use of curved blades or vanes.
Figure 9:
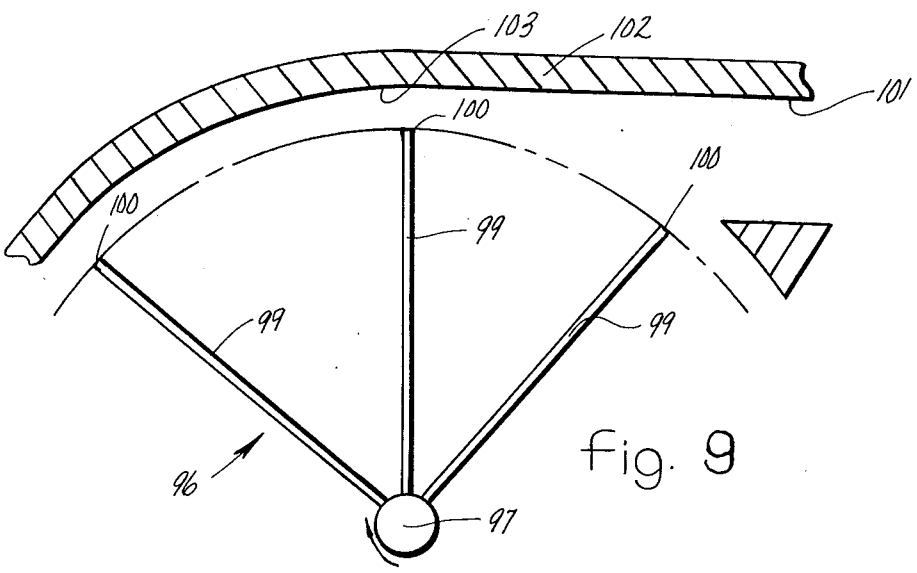
FIG. 9 is a fragmentary, radial section view of a centrifugal pump impeller, illustrating the use of straight vanes or blades.

FIGS. 9 and 10 illustrate the use of straight or curved impeller blades or vanes, respectively, in a pump impeller made in accordance with the principles of the present invention. In FIG. 9, the impeller is generally indicated by the numeral 96, and it includes a drive shaft 97 to which is fixedly secured a plurality of radially disposed impeller blades 99. The numeral 100 designates the outer ends or tips of the blades 99. The blades 99 would be of the type shown in FIG. 7, which are not provided with shrouds. The numeral 101 designates the discharge outlet which is formed in the pump casing 102. The numeral 103 designates the outer area or delivery area in the pump casing 102, adjacent the rotating tips 100 of the blades 99.

FIG. 10 illustrates an impeller 106 which includes a drive shaft 107 to which is fixedly secured the inner ends of a plurality of radially disposed, arcuate, impeller blades 109, the outer ends of which are indicated by the numeral 110. The numeral 111 designates the discharge outlet in the pump casing 112. The numeral 113 designates the outer area or delivery area in the casing 112, adjacent the rotating tips 110 of the blades 109.

Figure 11:
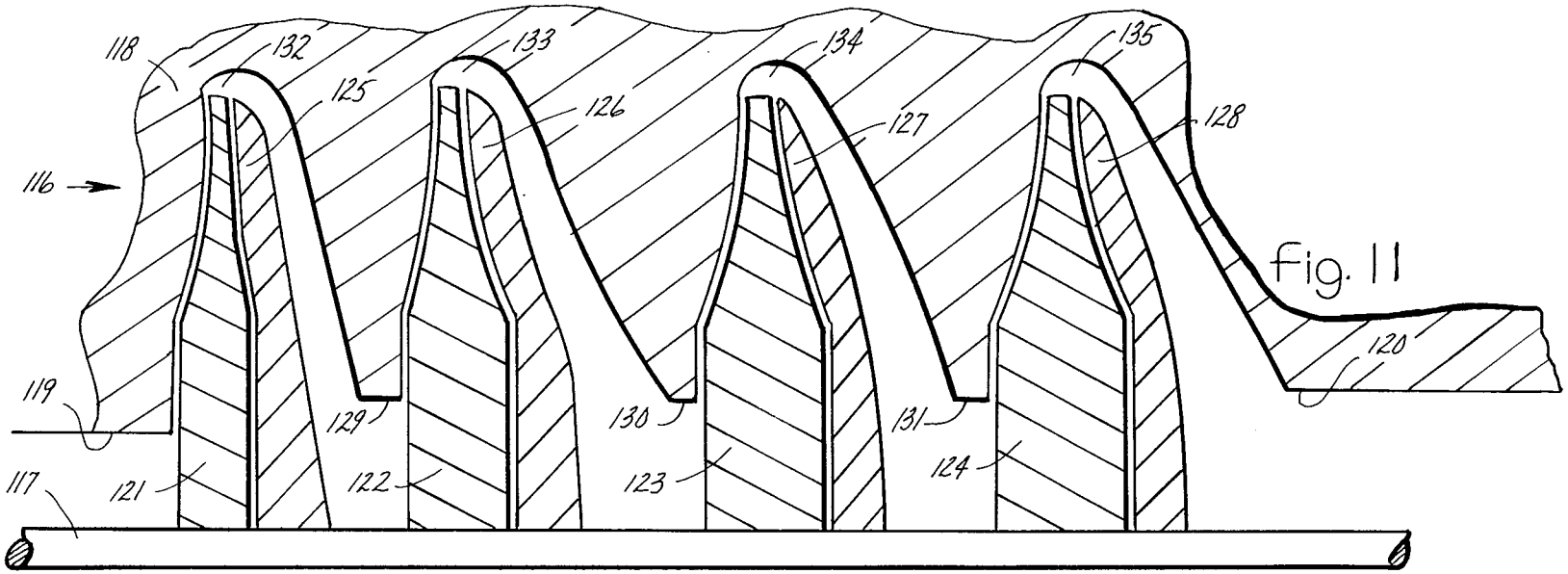
FIG. 11 is a meridional section view of a stage pump illustrating the increasing areas of successive impellers employed in a stage pump made in accordance with the principles of the invention.

FIG. 11 is a meridional section illustrating how the areas of the blades on successive impellers in a multi-stage centrifugal pump 116 have to be increased. The numeral 117 designates the drive shaft of the multi-stage pump 116. The numeral 119 designates the fluid inlet in the pump casing 118. The numerals 121, 122, 123, and 124 designate the blades of the impellers of each successive stage. The numerals 125, 126, 127 and 128 designate the blade shrouds for each successive stage. The numerals 129, 130 and 131 designate the discharge outlets for the first three stages of the pump, and the numeral 120 designates the pump outlet which would also be the discharge outlet for the fourth stage of the pump. The numerals 132, 133, 134 and 135 designate the outer or delivery area in the casing 118 at each of the tips of the blades 121 through 125, respectively, and which must each be equal to the discharge outlet areas 129, 130, 131 and 120, respectively. The shrouds 125 through 128 are illustrated as being attached to the drive shaft 117, however, it will be understood that they may be also secured to the blades 121 through 124, respectively, if desired.

What is claimed is:

1. In a centrifugal pump, the combination comprising:

(a) a casing having at least one impeller rotatably mounted therein and having an axial fluid inlet opening and a discharge outlet opening;

(b) said impeller being constructed for rotation in one direction so as to receive fluid from said casing axial inlet opening and exert a centrifugal force on said fluid to pressurize the fluid and force it into a delivery area and thence out of the casing through said casing discharge outlet opening;

(c) said impeller being provided with a plurality of radially disposed impeller blades which each has a tip, and which are evenly spaced, circumferentially, around the impeller, and have decreasing widths radially outward; and (d) the delivery area in the casing into which the impeller discharges fluid being equal to the circumferential area of the impeller at the discharge tips of the blades, and the area of said casing discharge outlet opening being at least equal to said delivery area and at least equal to said circumferential area.

2. In a centrifugal pump, the combination as defined in claim 1, wherein:

(a) each of the impeller blades are provided with shrouds.

3. In a centrifugal pump, the combination as defined in claim 1, wherein:

(a) the impeller blades are of the open type, and the contour of each of the impeller blades is complementary with the contour of the casing in which the blades are rotatably mounted.

4. In a centrifugal pump, as defined in claim 1, wherein:

(a) each of said impeller blades are curved blades.

5. In a centrifugal pump, as defined in claim 1, wherein:

(a) each of said impeller blades are straight.

6. A centrifugal pump, as defined in claim 1, wherein:

(a) said casing has a plurality of said impellers mounted therein to provide a multi-stage pump; and, (b) the impeller blades in each stage are of an increased width progressively from the stage adjacent the axial inlet opening to the stage adjacent the outlet opening.

* * * * *